US006889593B2

(12) United States Patent
Gühring et al.

(10) Patent No.: US 6,889,593 B2
(45) Date of Patent: May 10, 2005

(54) BLANK CARTRIDGE DEVICES AND FIREARMS DESIGNED THEREFOR

(75) Inventors: Manfred Gühring, Oberndorf (DE); Norbert Fluhr, Oberndorf (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 0 days.

(21) Appl. No.: 10/830,512

(22) Filed: Apr. 23, 2004

(65) Prior Publication Data

US 2005/0066804 A1 Mar. 31, 2005

Related U.S. Application Data

(63) Continuation of application No. PCT/EP02/11915, filed on Oct. 24, 2002.

(30) Foreign Application Priority Data

Oct. 24, 2001 (DE) ..... 101 52 588

(51) Int. Cl.[7] ..... F41A 21/00
(52) U.S. Cl. ..... 89/14.5; 42/96
(58) Field of Search ..... 89/14.5, 14.05, 89/14.2, 29; 42/96

(56) References Cited

U.S. PATENT DOCUMENTS

| | | | | | |
|---|---|---|---|---|---|
| 680,327 | A | * | 8/1901 | Hay | 89/14.5 |
| 3,440,924 | A | * | 4/1969 | Sawyer | 89/14.5 |
| 3,687,000 | A | * | 8/1972 | Csizmar et al. | 89/14.5 |
| 3,744,370 | A | * | 7/1973 | Snodgrass | 89/14.5 |
| 3,766,822 | A | * | 10/1973 | Sophinos | 89/14.5 |
| 4,499,811 | A | * | 2/1985 | Kaste | 89/14.5 |
| 4,685,378 | A | * | 8/1987 | Lusk et al. | 89/14.5 |
| 5,325,758 | A | | 7/1994 | Compton et al. | 89/14.5 |
| 5,377,438 | A | | 1/1995 | Sheinfeld et al. | 42/96 |
| 5,574,245 | A | * | 11/1996 | Buc et al. | 102/485 |
| 6,026,728 | A | | 2/2000 | Guhring et al. | 89/14.5 |
| 6,176,032 | B1 | | 1/2001 | Cohen et al. | 42/96 |
| 6,289,623 | B1 | * | 9/2001 | Cohen et al. | 42/96 |

FOREIGN PATENT DOCUMENTS

| | | | | |
|---|---|---|---|---|
| CH | 381569 | | 8/1964 | |
| EP | 0 928 943 | A2 | 7/1999 | |
| EP | 0 928 943 | A3 | 8/2000 | |
| GB | 2189581 | A * | 10/1987 | F41D/11/00 |

OTHER PUBLICATIONS

"International Preliminary Examination Report" (one copy in German and one copy in English), Patent Cooperation Treaty, Apr. 15, 2004, 9 pages total.

* cited by examiner

*Primary Examiner*—Michael J. Carone
*Assistant Examiner*—M. Thomson
(74) *Attorney, Agent, or Firm*—Hanley, Flight & Zimmerman, LLC

(57) ABSTRACT

A blank cartridge device is disclosed. According to one example, the blank cartridge device includes a frame, a threaded bush, a nozzle body, and a cover bushing. In such an arrangement, the frame may include first and second longitudinal sides and front and rear sides, wherein the rear side includes a laterally open recess, and wherein the frame is laterally deferrable on a muzzle flash eliminator of an automatic firearm. The nozzle body may include a male thread on the outer periphery of the nozzle body and may be adapted to be screwed into the threaded bush and to extend into the muzzle flash eliminator. In one example, the nozzle body includes a longitudinal tapped blind hole extending a length within the nozzle body and a spray hole extending from a muzzle at an outer surface of the nozzle body to the longitudinal tapped blind hole and the longitudinal tapped blind hole includes an elongated portion extending beyond the spray hole and having a volume of at least one bullet discharged from the automatic firearm. The cover bushing is connected with the threaded bush, wherein the cover bushing is located over the nozzle body when the nozzle body is screwed into the threaded bush.

17 Claims, 4 Drawing Sheets

BLANK CARTRIDGE DEVICES AND FIREARMS DESIGNED THEREFOR

CROSS-REFERENCE TO RELATED APPLICATIONS

This case is a continuation of International Patent Application PCT/EP02/11915, filed Oct. 24, 2002.

TECHNICAL FIELD

The present disclosure pertains to firearms and, more particularly, to blank cartridge devices and firearms designed therefor.

BACKGROUND

Blank cartridge devices have been known for some time due to U.S. Pat. No. 3,744,370. This known blank cartridge device consists of an almost rectangular, oblong frame having a laterally open recess in its rear transverse side (in further explanations, "front" and "rear" always refer to the firing direction). The frame is sized to be pushed from the side over the muzzle flash eliminator of the firearm. The recess in the rear transverse side thereby engages in the exterior ring groove on the muzzle flash eliminator.

A threaded bush is introduced in the front transverse side. If the frame is placed on the muzzle flash eliminator in the manner described, then the axis of the threaded bush aligns with the bore axis of the barrel.

The nozzle body is now inserted into this threaded bush from the front and its male thread is screwed into the internal thread of the threaded bush until its rear end sits securely on the muzzle. A removable transverse pin in the front end of the nozzle body serves as the tool for tightening the thread so that the blank cartridge device is clamped tightly on the muzzle flash eliminator.

The tapped blind hole connects directly to the barrel hole and ends where the spray hole pushes through the wall of the nozzle body. The spray hole then lies within the muzzle flash eliminator, but is arranged in such a manner that it can blow outwards unimpeded through the slits of the muzzle flash eliminator.

Overall, the known muzzle flash eliminator should be implemented in a manner so that it is strong enough to withstand a shot, if by mistake a live cartridge, instead of a blank cartridge, is fired. Splinters may occur if the nozzle body should break, and these fragments can escape through the slits in the muzzle flash eliminator. Fine metal splinters from the shell can also escape straight through the nozzle hole when firing with blank cartridges and can cause injury in some cases.

The mounting is also not ideal because a special tool, which can be lost, is required to tighten the thread. However, if the nozzle body is loosened during shooting then the combustion gases from the discharged blank cartridge flow past the nozzle body and particles can be shot out. Certain blank cartridges (those with wood projectiles, for example) tend to release splinters that can still be extremely dangerous right in front of the muzzle.

In any case, a jam is caused when a vapor recovery system, for which the nozzle hole is aligned, is needed for the firearm to function properly. A loose-fitting blank cartridge device ensures the escape of some gas so that the firearm can be easily charged.

Many of these disadvantages are addressed by a blank cartridge device as described in DE 197 29 565. However, this improved blank cartridge device is very costly to manufacture.

DETAILED DESCRIPTION

Figure 1:
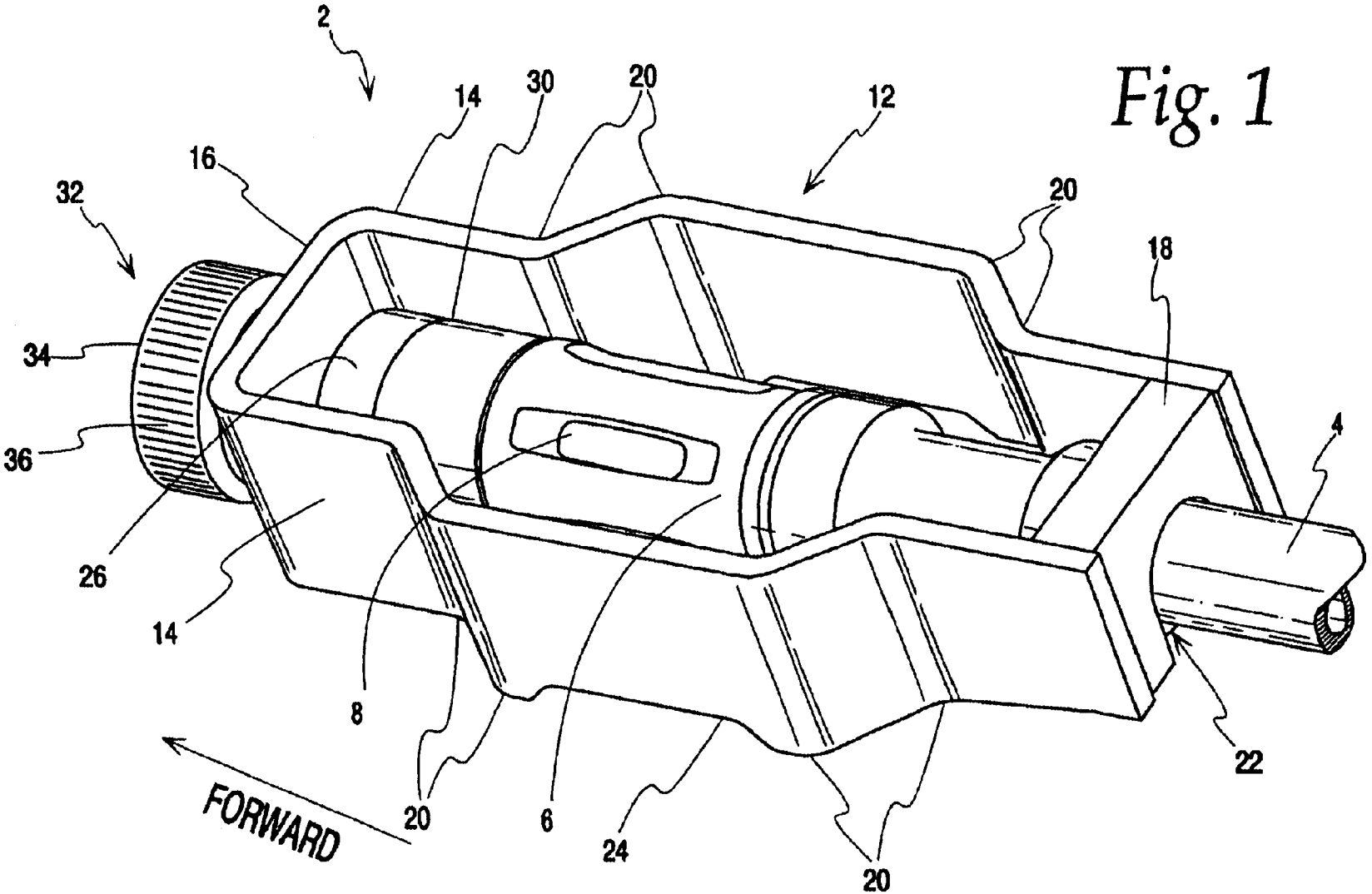
FIG. 1 shows a trimetric view of a firearm muzzle, including a muzzle flash eliminator, on which a first example disclosed blank cartridge device is placed.
Figure 2:
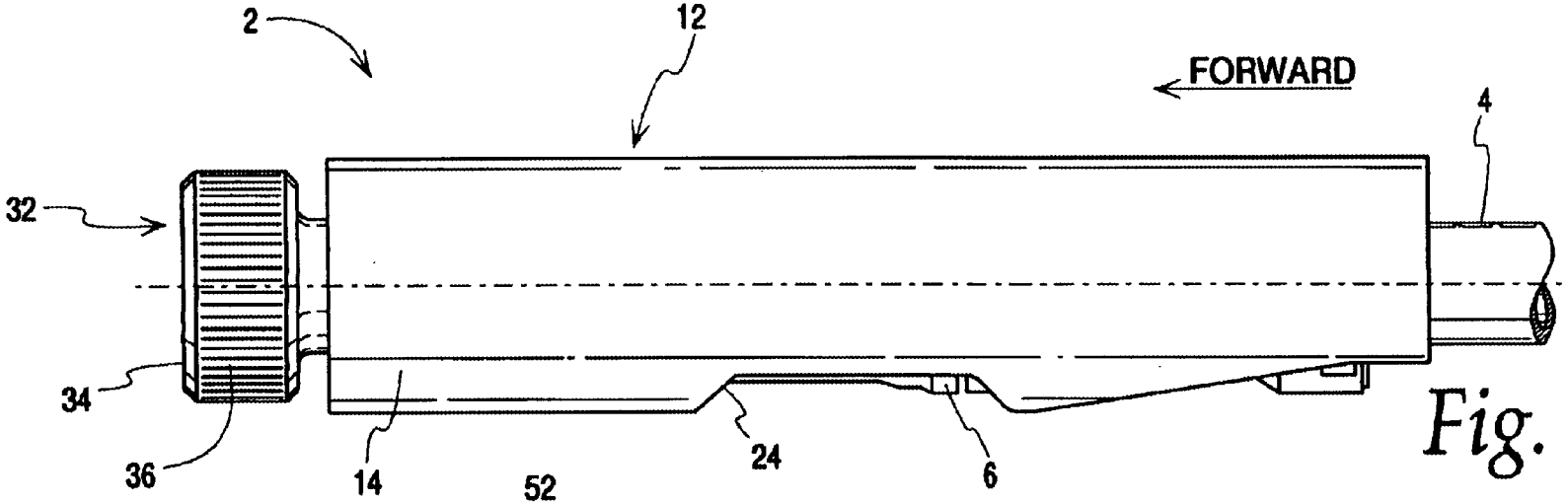
FIG. 2 shows a side elevational view of firearm muzzle and first example disclosed blank cartridge device of FIG. 1.

As shown in FIGS. 1–4, a first example of a blank cartridge device 2 is shown affixed to a muzzle of a barrel 4 of a firearm, such as a rapid-fire or automatic weapon. A muzzle flash eliminator 6 is screwed onto the barrel 4 and fixed thereon by a transverse pin (not shown) The muzzle flash eliminator 6 has, as is common, an axial hole having a female thread on its rear end that is screwed onto a male thread of barrel 4. The muzzle flash eliminator includes a number of gas escape slots 8 and a break 9 at which the axial hole of the muzzle flash eliminator is narrowed down to a measurement slightly larger than that of the barrel 4. Past the break 9, the muzzle flash eliminator 6 includes a conical section 10 that expands as it extends in the forward direction.

The blank cartridge device 2 includes an oblong rectangular frame 12 having first and second longitudinal sides 14, a front transverse side 16, and a rear transverse side 18. In one implementation, the first and second longitudinal sides 14 may be integrally formed with the front transverse side 16. As shown in FIG. 1, the first and second longitudinal sides 14 include two cranks 20.

Figure 7:
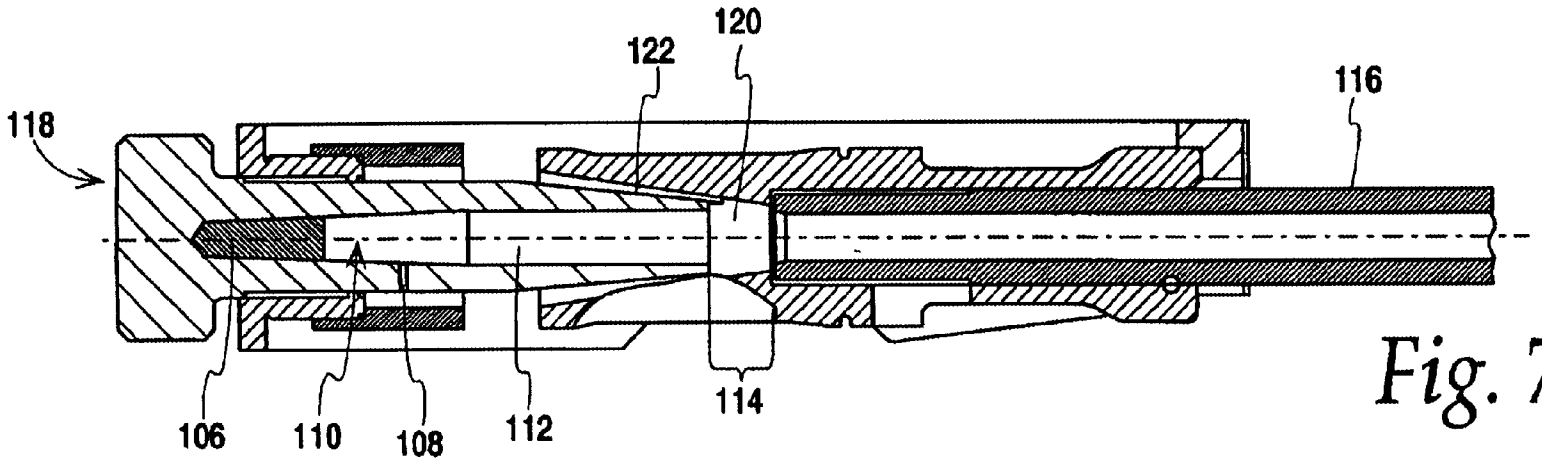
FIG. 7 shows a cross-sectional view of the firearm muzzle and second example disclosed blank cartridge device taken generally along line 7—7 of FIG. 6, but after firing of a live cartridge.

In response to axial force in the forward direction resulting from a projectile, such as a bullet, being launched from the barrel 4, the cranks 20 can be bent or extended longitudinally. The ductility of the cranks 20 depends on the material from which the first and second longitudinal sides 14 are formed and the thickness of such material. Thin the first and second longitudinal sides 14 can bend permanently to the extended position as shown in FIG. 7, below. Additionally, in some configurations, the cranks 20 may be configured to spring from the extended position back to the positions shown in FIG. 1. Accordingly, the cranks 20 serve as a force-catch to prevent a longitudinal force that can damage threads that holds the muzzle flash eliminator 6 on the barrel 4.

The rear transverse side 18 includes a round, centric recess 22, the radius of which is complementary to that of barrel 4 directly behind the muzzle flash eliminator 6. One side of the recess 22 is open so that the frame 12 can then be pushed over the muzzle flash eliminator 6, whereby the recess 22 is pushed across the barrel 4.

The height of the first and second longitudinal sides 14, as seen transversely to the direction of fire, is larger than the diameter of the muzzle flash eliminator 6. In one example, one of the longitudinal sides 14 may include a recess 24, in which the contour of the muzzle flash eliminator 6 can be seen so that it is easy to determine whether or not frame 12 is placed properly over the muzzle flash eliminator 6. The side of the recess 24 corresponds to the side on which the recess 22 is open. The rear ends of the first and second longitudinal sides 14 are also sloped in height toward the rear so that their heights are slightly larger than the diameter of the barrel 4 at the rear transverse side 18, which makes it easier to attach and control the seat of frame 12 on the barrel 4.

The blank cartridge device 2 also includes a threaded bush 26 that is attached in the center of the front transverse side 16 in a perpendicular orientation and extending towards the rear. The threaded bush 26 may be fabricated as a unitary piece with the front transverse side 16. Alternatively, the threaded bush 26 may be welded, soldered, or otherwise affixed to the front transverse side 16. The threaded bush 26 and the front transverse side 16 both include through holes having a fine female thread that extends up to the rear end of the threaded bush 26.

A cover bushing 30 is attached the rear end of the threaded bush 26. The cover bushing 30 may be unitary with the threaded bush 26 or it can be welded or hard-soldered on it thereto as shown in FIG. 8. The cover bushing 30 includes a through hole that is distinctly larger than the tapped hole through the threaded bush 26, but the through hole of the cover bushing 30 is smaller than the outer diameter of the threaded bush 26.

During installation, the blank cartridge device 2 is placed over the muzzle flash eliminator 6 and a nozzle body 32 is inserted through the frame 12 and screwed tightly into the threaded bush 26. Together, the frame 12 and the nozzle body 32 form the blank cartridge device 2. Another part is not needed.

The nozzle body 32 is designed like an oblong bolt and includes a head 34 having an exterior perimeter that is provided with a strong knurl 36 as a handle. The head 34 may also include a slot into which a screwdriver blade may be placed. The nozzle body 32 includes an oblong shaft 38 having a male thread. The oblong shaft 38 is complementary in length and diameter to the fine female thread in threaded bush 26 and the front transverse side 16. The diameter of the oblong shaft 38 tapers conically toward the rear of the oblong shaft 38. The cone at the rear of the oblong shaft 38 of the nozzle body 32 corresponds to the conical section 10 of the muzzle flash eliminator 6 in such a manner that, when correctly mounted, the oblong shaft 38 enters into and grips the conical section 10 in the muzzle flash eliminator 6. The rear end of the shaft thereby forms a gap 40, which is small and mainly corresponds to the tolerances in the direction of fire, towards the muzzle of the barrel 4.

The nozzle body 32 includes a center tapped blind hole 41 that extends within the interior of the nozzle body 32 from the rear end of the nozzle body 32 near the conical section 10 to approximately at the rear end of the head 34. The tapped blind hole 41 of the nozzle body 32 is arranged concentrically on the bore axis of the barrel 4. The tapped blind hole 41 includes a rear section 42 that is somewhat larger than the caliber size of the barrel 4. The rear section 42 of the tapped blind hole 41 extends forward to a break 44. Forward from the break 44, the diameter of the tapped blind hole 41 has a diameter that is smaller than barrel caliber size.

Figure 4:
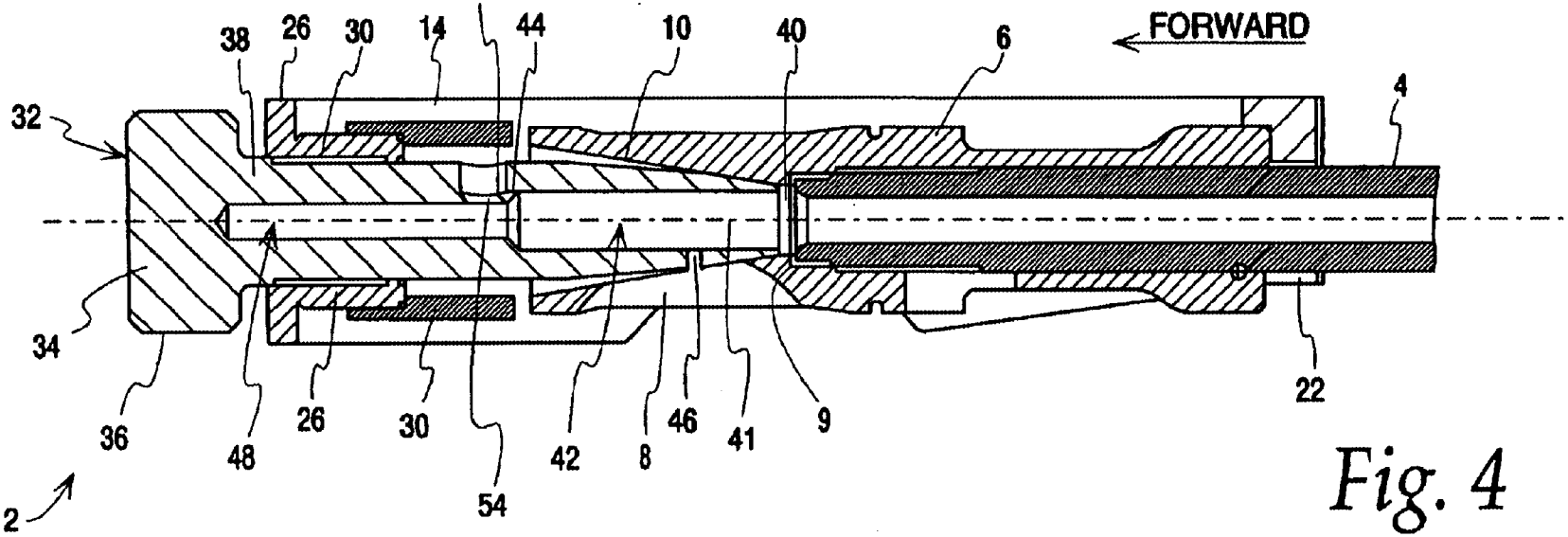
FIG. 4 shows a cross-sectional view of the firearm muzzle and first example disclosed blank cartridge device taken generally along line 4—4 of FIG. 3.

A transverse spray hole 46 intersects into the tapped blind hole 41 at a location in behind of the break 44, but could also be displaced more forward than shown in the drawings. As shown in FIG. 4, the spray hole 46 passes through the wall of the nozzle body 32 and opens towards the outside at a location below the muzzle flash eliminator 6 in the annular gap between the exterior surface of the conical section 10 of the nozzle body 32 and the interior surface of the cover bushing 30 when the blank cartridge device is fired. The section of the tapped blind hole 41 forward from the break 44 is referred to as an elongated section 48, which has a volume that is at least equal to the volume of a bullet discharged from the barrel 4 and may be equal to the volume of two bullets.

When using the blank cartridge device 2, the frame 12 is placed on the muzzle flash eliminator 6 and the nozzle body 32 is inserted and screwed tightly from the front into the threaded bush 26. The conical section 10 of the muzzle flash eliminator 6 thereby secures the nozzle body 32. At this point, blank cartridges can be fired by the firearm. Powder gases (and, as the case may be, splinters of wood) from blank cartridge firing reach the tapped blind hole 41 and are expelled through the spray hole 46. The solid particles from cartridge firing are retained in the elongated section 48.

Because the described conical section 10 is sealed by the nozzle body 32, gases cannot escape laterally therefrom. The size of the spray hole 46 is such that the pressure required for the through-loading function of the automatic weapon or firearm associated with the barrel 4 is maintained.

However, as already described, it is possible that a live cartridge may get mixed up with the blank cartridges and inadvertently fired from the barrel 4. When such an event occurs, a bullet 50 from the live cartridge passes unhindered by the over-caliber-size rear section 42 of the tapped blind hole 41 and collides against the break 44, which is narrower in diameter than the rear section 42 of the tapped blind hole 41. The reduced diameter of the break 44 causes the bullet 50 to be warped on its front and greatly decelerated as it passes into the under-caliber-sized elongated section 48 of the tapped blind hole 41. Because the elongated section 48 following break 44 is relatively long, the bullet 50 is effectively decelerated by the time it approaches the elongated section 48. As the bullet 50 passes through the elongated section 48 of the tapped blind hole 41, the diameter of the tapped blind hole 41 is thereby greatly widened.

Figure 5:
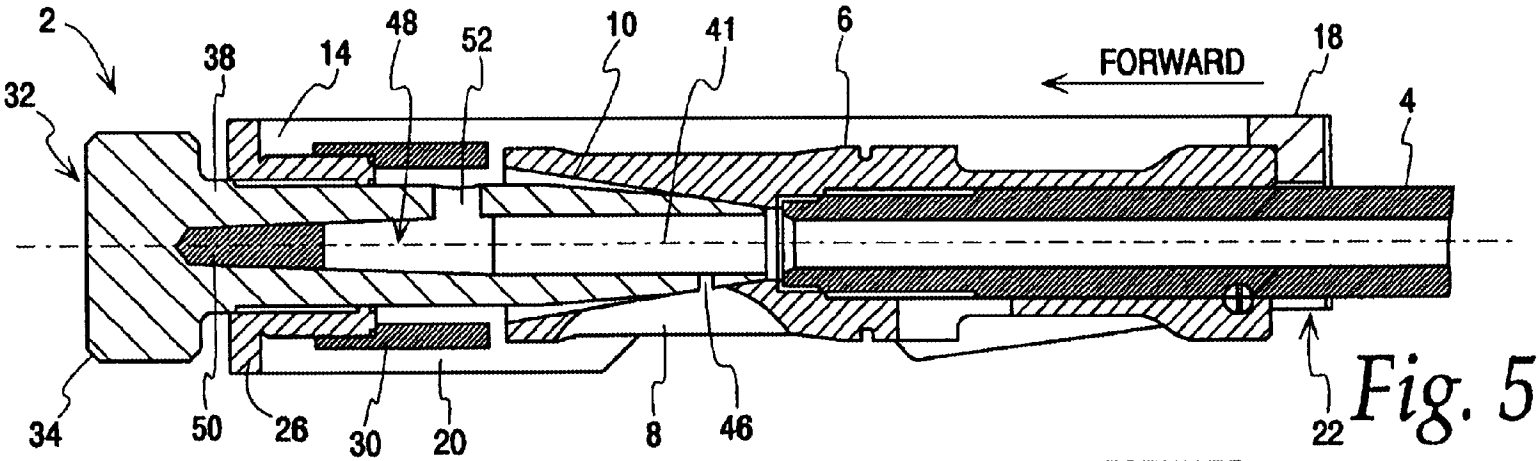
FIG. 5 shows a cross-section view, as in FIG. 4, but after the firing of a live cartridge.
Figure 3:
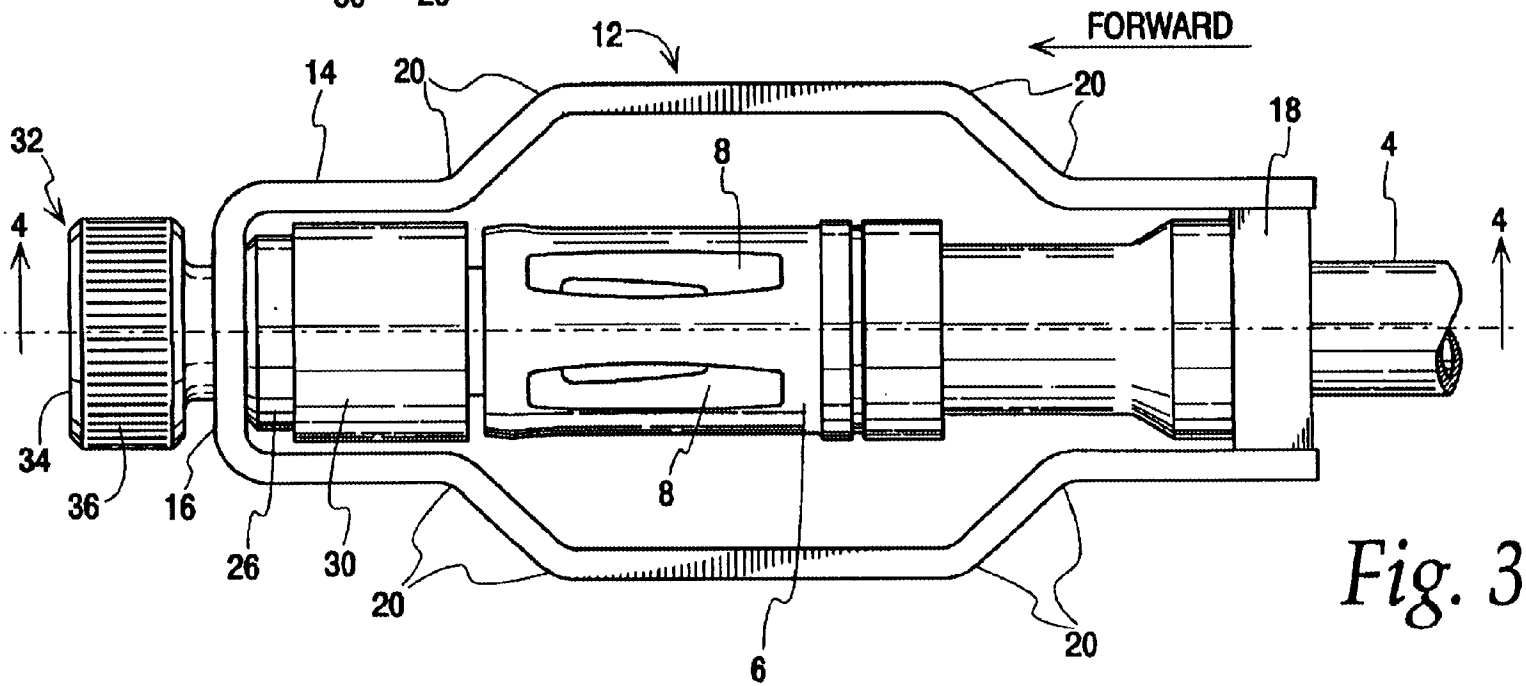
FIG. 3 shows a plan view of the firearm muzzle and first example disclosed blank cartridge device of FIG. 1.

As shown in FIGS. 4 and 5, a transverse tapped bore hole 52 extends from the outside surface of the nozzle body 32 to a location short of the elongated section 48, thereby leaving a material base 54 in the area of the break 44 between the transverse tapped bore hole 52 and the elongated section 48. The material base 54 is strong enough to remain undamaged during the firing of blank cartridges, but is removed as the bullet 50 from the firing of a live cartridge passes the material base 54 due to the diameter of the bullet 50 being larger than the diameter of the elongated section 48. Accordingly, if a live cartridge is fired, its bullet 50 tears open the material base 54, and the increased amount of gas associated with a live shot can be discharged through the now opened hole formed by the transverse tapped bore hole 52. However, the form of the nozzle body 32 generally remains straight, because it is held in the rear by the conical section 10 and in the front by the thread connection in the threaded bush 26. Thus, a second live shot may still be accommodated, but the removed material base 54 and the transverse tapped bore hole 52 provides such a large opening that the gas pressure decreases abruptly. As the case may be, the longitudinal sides 14 of the frame 12 may be stretched for a short period of time to absorb the energy from the bullet 50 from the live cartridge, because the longitudinal sides 14 have spring-like properties due to the cranks 20.

Figure 6:
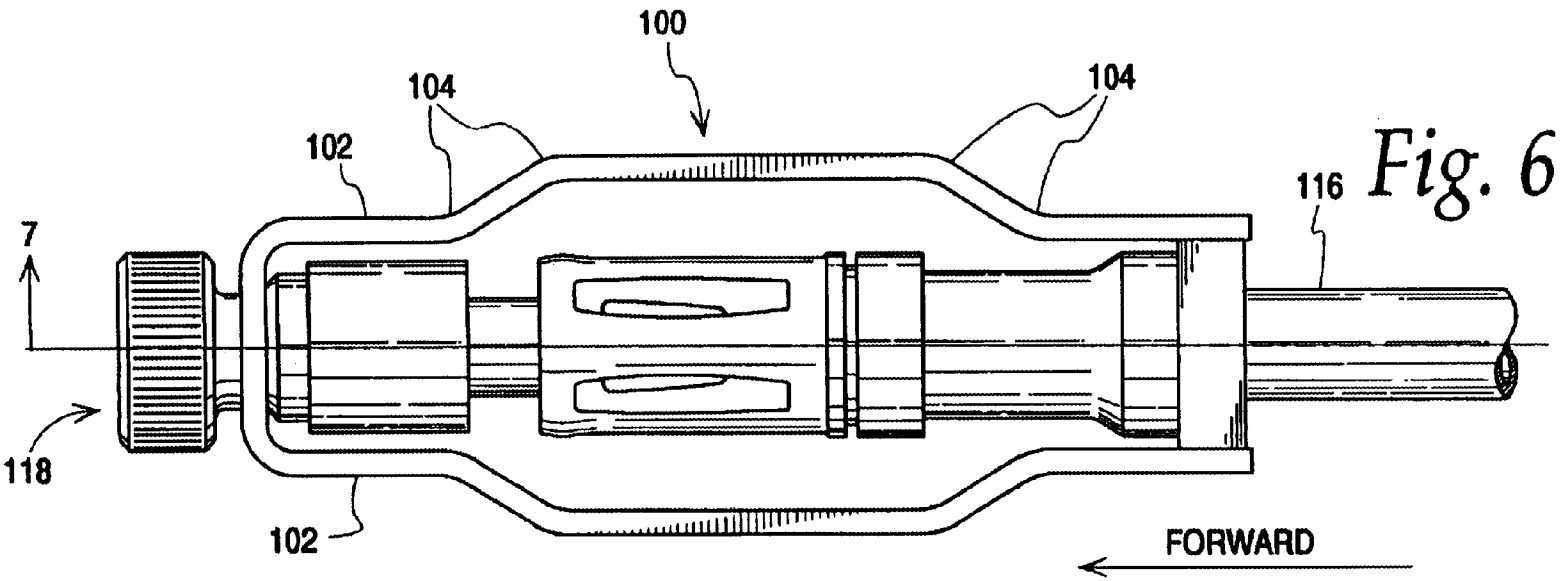
FIG. 6 shows a plan view of a firearm muzzle and a second example disclosed blank cartridge device.

A second example blank cartridge device 100 is represented in FIGS. 6 and 7. Unlike the first example blank cartridge device 2, the second example blank cartridge device 100 does not include the transverse tapped bore hole 52 or another predetermined breaking point. Rather, the longitudinal sides 102, which include cranks 104, of the second example blank cartridge device 100 are fabricated from thin material that is permanently deformable. Accordingly, if a live cartridge is fired, a bullet 106 therefrom passes by a spray hole 108, which is located under a cover bushing 109, and ends up in an elongated section 110 of a tapped bore hole 112. In such a situation, the cranks 104 are expanded by the impact of the bullet 106 on the elongated section 110 so that a distance 114 between a barrel 116 and a rear end of a nozzle body 118 is expanded, thereby creating a gap 120 between a conical section 122 and the rear end of the nozzle body 118. The gap 120 forms a gas outlet, from which the powder gases from the firing of a live cartridge can escape.

The disclosure concerns a blank cartridge device including a frame with two longitudinal sides and two transverse sides, whereby the front transverse side has a threaded bush and the rear transverse side has a laterally open recess and an axially symmetric nozzle body with a male thread and a longitudinal tapped blind hole, starting from its rear end, into which a transverse spray hole discharges. In such an arrangement, the frame is laterally deferrable on the muzzle flash eliminator of an automatic firearm and then the nozzle body with its male thread can be screwed into the threaded bush and inserted into the muzzle flash eliminator. Furthermore, the disclosure concerns an automatic firearm, such as an automatic weapon, that is equipped with a muzzle flash eliminator and such a blank cartridge device.

As disclosed herein, the disclosed blank cartridge device holds back all particles during the firing of a blank cartridge, as well as the firing of a live cartridge, and is also inexpensive to produce. Accordingly, as disclosed herein, a cover bushing connected with the threaded bush sits with clearance over the screwed-on nozzle body and the tapped blind hole is lengthened beyond the nozzle hole until the lengthened section has the volume of at least one bullet.

The nozzle body may be elongated with respect to known nozzle bodies, because the tapped blind hole, which passes axially through the nozzle body, is also elongated.

The cover bushing may cover the exterior muzzle of the spray hole so that the gases cannot escape linearly but, rather, can only escape in a labyrinth-like path. This also applies if the cover bushing does not lie inside the muzzle flash eliminator, but rather in front of it.

As described above, if a live shot is accidentally fired, then the elongation of the tapped blind hole accommodates at least one bullet. The kinetic energy of any fragments potentially escaping through the nozzle hole is dissipated by the distance covered in the aforementioned labyrinthine path.

In one example, the elongated section has a volume that can at least accommodate two bullets. Accordingly, if several live cartridges are loaded consecutively into the magazine and are fired in sustained firing, the bullets associated with such live cartridges are retained in the elongated section. Incidentally, the firing of a live cartridge with an attached blank cartridge device differs drastically from the firing of a blank cartridge such that the shooter immediately notices his mistake. It can also be expected that a jam will occur in many cases due to the considerable increase in gas pressure, because the speed of the locking of the firearm is too high to ensure safe reloading.

With a blank cartridge device in accordance with the description, the threaded bush is inserted in the frame so that the material of each of these parts can be optimized individually. However, it is possible that the threaded bush is designed as one piece together with the frame. Such a construction enables a more stable construction of the device.

In some arrangements, the threaded bush extends out from the front transverse side towards the rear. Due to the occurring force, the threaded bush is namely pushed forward and against the front transverse sides of the frame, which not only ensures a particularly good power transmission, but also enables longer longitudinal sides of the frame.

The muzzle flash eliminator usually has a conical hole to which a cylindrical hole section sometimes also connects in the back. The threaded bush may be directly supported by the muzzle of the barrel, thereby passing through the muzzle flash eliminator without cooperating with it via a certain centering device. Therefore, the threaded bush is also designed as an expansion bushing to avoid a loosening of the thread under heat-induced length changes between the barrel and nozzle body. In contrast, as disclosed herein, the rear end of the threaded bush also be designed conically complementary to the conical hole in the muzzle flash eliminator, so that the rear end of the screwed-in nozzle body is supported with a conical seat on the muzzle flash eliminator. This cone or cone seat works like a rotary protector to prevent unwanted loosening during firing, but can be easily loosened by rotating the nozzle body during unscrewing. A special tool as known from the state of the art is thus superfluous.

The disclosed blank cartridge device includes a transverse tapped blind hole is arranged near the minimized tapped blind hole. A remaining material base can be left such that it remains undamaged in each case when firing blank cartridges. However, under the pressure of a bullet from a live cartridge, the remaining material base breaks open as a predetermined breaking point and the firing gases can escape through the enlarged hole. The also occurring splinters are shielded by the cover bushing so that their kinetic energy is greatly dissipated.

In another example, the blank cartridge device includes longitudinal frame sides that are extendable. Depending on the ductility, thickness, and length of the longitudinal sides, these longitudinal sides can more or less extend when a bullet comes to rest in the tapped blind hole of the nozzle body. It is not so much that the sides themselves are bent, but rather mainly the crank or cranks are bent straight. This causes the frame to become a bit longer. If this elongation is considerable, then the aforementioned predetermined breaking point can be forgone since the nozzle body also moves forward a bit with the elongation of the frame. Gas can escape all around the cone area. A thin frame material supports the elongation of the longitudinal sides.

The blank cartridge device can engage in a peripheral groove of the muzzle flash eliminator. However, the rear transverse sides of the frame may extend behind the muzzle flash eliminator. Accordingly, blank cartridge devices for already existing firearms, in particular rapid firing guns, can be retrofitted without requiring the modification of the muzzle flash eliminator.

As already mentioned above, the disclosed blank cartridge device requires no additional, special tool. A screwdriver slit in the front end of the nozzle body suffices instead, for example. The nozzle body may include a handle on the front end, such a handle may include a knurl. On a properly installed muzzle flash eliminator, this knurl is located in front of the front transverse side of the frame. This knurl can be easily grasped, in an emergency using a rag. A torsional moment can be applied to the nozzle body that is sufficient for its tightening and loosening.

As already mentioned above, the disclosure not only concerns a blank cartridge device, but also an automatic firearm with a muzzle flash eliminator and with a blank cartridge device as described above.

Although certain apparatus constructed in accordance with the teachings of the invention have been described herein, the scope of coverage of this patent is not limited thereto. On the contrary, this patent covers every apparatus, method and article of manufacture fairly falling within the scope of the appended claims either literally or under the doctrine of equivalents.

What is claimed is:

1. A blank cartridge device comprising:

a frame including first and second longitudinal sides and front and rear sides, wherein the rear side includes a laterally open recess, and wherein the frame is laterally deferrable on a muzzle flash eliminator of an automatic firearm;

a threaded bush disposed within the front side;

a substantially axially symmetric nozzle body including a male thread on the outer periphery of the nozzle body and adapted to be screwed into the threaded bush and to extend into the muzzle flash eliminator, wherein the nozzle body includes a longitudinal tapped blind hole extending a length within the nozzle body and a spray hole extending from a muzzle at an outer surface of the nozzle body to the longitudinal tapped blind hole, and wherein the longitudinal tapped blind hole includes an elongated portion extending beyond the spray hole and having a volume of at least one bullet discharged from the automatic firearm; and a cover bushing connected with the threaded bush, wherein the cover bushing is located over the nozzle body when the nozzle body is screwed into the threaded bush.

2. A blank cartridge device as defined by claim 1, wherein the cover bushing covers the muzzle of the spray hole.

3. A blank cartridge device as defined by claim 1, wherein the threaded bush is unitary with the front side of the frame.

4. A blank cartridge device as defined by claim 1, wherein the threaded bush extends toward the muzzle flash eliminator from the front side of the frame.

5. A blank cartridge device as defined by claim 1, wherein the muzzle flash eliminator includes a conical section and wherein the nozzle body includes a conically shaped outer surface that is complimentary to the conical section and the conically shaped outer surface sits in the conical section when the nozzle body is screwed into the threaded bush.

6. A blank cartridge device as defined by claim 1, wherein the longitudinal tapped blind hole includes a breaking point.

7. A blank cartridge device as defined by claim 6, wherein when the nozzle body is screwed into the threaded bush the breaking point is located under the cover bushing and between the elongated section and the spray hole.

8. A blank cartridge device as defined by claim 6, wherein the breaking point is proximate a portion of base material that separates a tapped bore hole from tapped blind hole in the nozzle body.

9. A blank cartridge device as defined by claim 8, wherein the tapped blind hole has a reduced diameter near the tapped bore hole.

10. A blank cartridge device as defined by claim 1, wherein the first and second longitudinal sides each have at least one crank that is ductile.

11. A blank cartridge device as defined by claim 10, wherein the rear side of the frame extends behind the muzzle flash eliminator when the frame is installed on the automatic firearm.

12. A blank cartridge device as defined by claim 11, wherein the nozzle further comprises a handle including a knurl.

13. An automatic firearm comprising:

a muzzle;

a muzzle flash eliminator disposed on the muzzle;

a frame including first and second longitudinal sides and front and rear sides, wherein the rear side includes a laterally open recess, and wherein the frame is laterally deferrable on the muzzle flash eliminator;

a threaded bush disposed within the front side;

a substantially axially symmetric nozzle body including a male thread on the outer periphery of the nozzle body and adapted to be screwed into the threaded bush and to extend into the muzzle flash eliminator, wherein the nozzle body includes a longitudinal tapped blind hole extending a length within the nozzle body and a spray hole extending from an opening at an outer surface of the nozzle body to the longitudinal tapped blind hole, and wherein the longitudinal tapped blind hole includes an elongated portion extending beyond the spray hole and having a volume of at least one bullet discharged from the automatic firearm; and a cover bushing connected with the threaded bush, wherein the cover bushing is located over the nozzle body when the nozzle body is screwed into the threaded bush.

14. An automatic firearm as defined by claim 13, wherein the muzzle flash eliminator includes a conical section and wherein the nozzle body includes a conically shaped outer surface that is complimentary to the conical section and the conically shaped outer surface sits in the conical section when the nozzle body is screwed into the threaded bush.

15. An automatic firearm as defined by claim 13, wherein the longitudinal tapped blind hole includes a breaking point.

16. An automatic firearm as defined by claim 15, wherein when the nozzle body is screwed into the threaded bush the breaking point is located under the cover bushing and between the elongated section and the spray hole.

17. An automatic firearm as defined by claim 15, wherein the breaking point is proximate a portion of base material that separates a tapped bore hole from tapped blind hole in the nozzle body.

* * * * *